US006926143B1

(12) United States Patent
Chen

(10) Patent No.: US 6,926,143 B1
(45) Date of Patent: Aug. 9, 2005

(54) CASE FOR TOOL SHAFTS

(76) Inventor: Kun-Chen Chen, No. 6, Lane 609, Sec. 1, Chung-Shan Rd., Ye-Her Li, Tachia Chen, Taichung Hsien (TW)

( * ) Notice: Subject to any disclaimer, the term of this patent is extended or adjusted under 35 U.S.C. 154(b) by 0 days.

(21) Appl. No.: 10/774,428

(22) Filed: Feb. 10, 2004

(51) Int. Cl.[7] ..... B65D 85/28
(52) U.S. Cl. ..... 206/378; 206/349; 206/806
(58) Field of Search ..... 206/372, 373, 206/376, 378, 349, 1.5, 806; 211/60.1, 69

(56) References Cited

U.S. PATENT DOCUMENTS 5,595,294 A * 1/1997 McKenzie et al. ..... 206/349
6,698,600 B1 * 3/2004 Lee ..... 211/70.6
6,702,112 B1 * 3/2004 Henderson ..... 206/350
6,742,653 B2 * 6/2004 Kao ..... 206/373

* cited by examiner

*Primary Examiner*—Shian T. Luong
(74) *Attorney, Agent, or Firm*—Bacon & Thomas PLLC

(57) ABSTRACT

A case for tool shafts has a housing with an opening and an entrance, a sliding member slidably mounted on the housing, a top cap covering the opening, a bottom cap covering the entrance and an optional suspension plate. The multiple tool shafts are movably accommodated inside the housing in parallel and pushed to the opening by the sliding member. Thereby, the multiple tool shafts are arranged inside the case in an orderly manner. An individual tool shaft can be positioned at the opening by the sliding member removed conveniently from the housing through the opening.

7 Claims, 6 Drawing Sheets

CASE FOR TOOL SHAFTS

BACKGROUND OF THE INVENTION

1. Field of the Invention

The invention relates to a case for tool shafts, and particularly to a portable case that holds the tool shafts orderly.

2. Description of Related Art

With reference to FIG. 6, a conventional toolbox for general use is well known and typically includes a base in the form of an open-topped box (60) and a lid (70) pivotally attached to the box (60). The lid (70) has a clip (not shown) or other means to hold the lid (70) shut. The conventional toolbox typically has multiple compartments (80) to hold various tools and components, such as tool shafts.

However, the conventional toolbox does not have features to efficiently arrange the various tools. A person cannot conveniently select or remove appropriate tool shafts from the toolbox. When tool shafts are stored in compartments in the conventional toolbox and mounted in various tools, finding a particular tool shaft among many similar tool shafts is difficult.

The present invention has arisen to mitigate or obviate the disadvantages of storing tool shafts.

SUMMARY OF THE INVENTION

A main objective of the present invention is to provide a case that conveniently holds multiple tool shafts in order.

Further benefits and advantages of the present invention will become apparent after a careful reading of the detailed description in accordance with the drawings.

DETAILED DESCRIPTION OF THE PREFERRED EMBODIMENT

A case for tool shafts in accordance with the present invention comprises a housing, a sliding member, a top cap, a bottom cap and an optional suspension device. The housing has an opening and an entrance. The sliding member is mounted slidably on the housing. Multiple tool shafts are held movably inside the housing in parallel and are pushed toward the opening by the sliding member. Thereby, an individual tool shaft is positioned at the opening by the sliding member and is removed conveniently from the housing through the opening.

Figure 1:
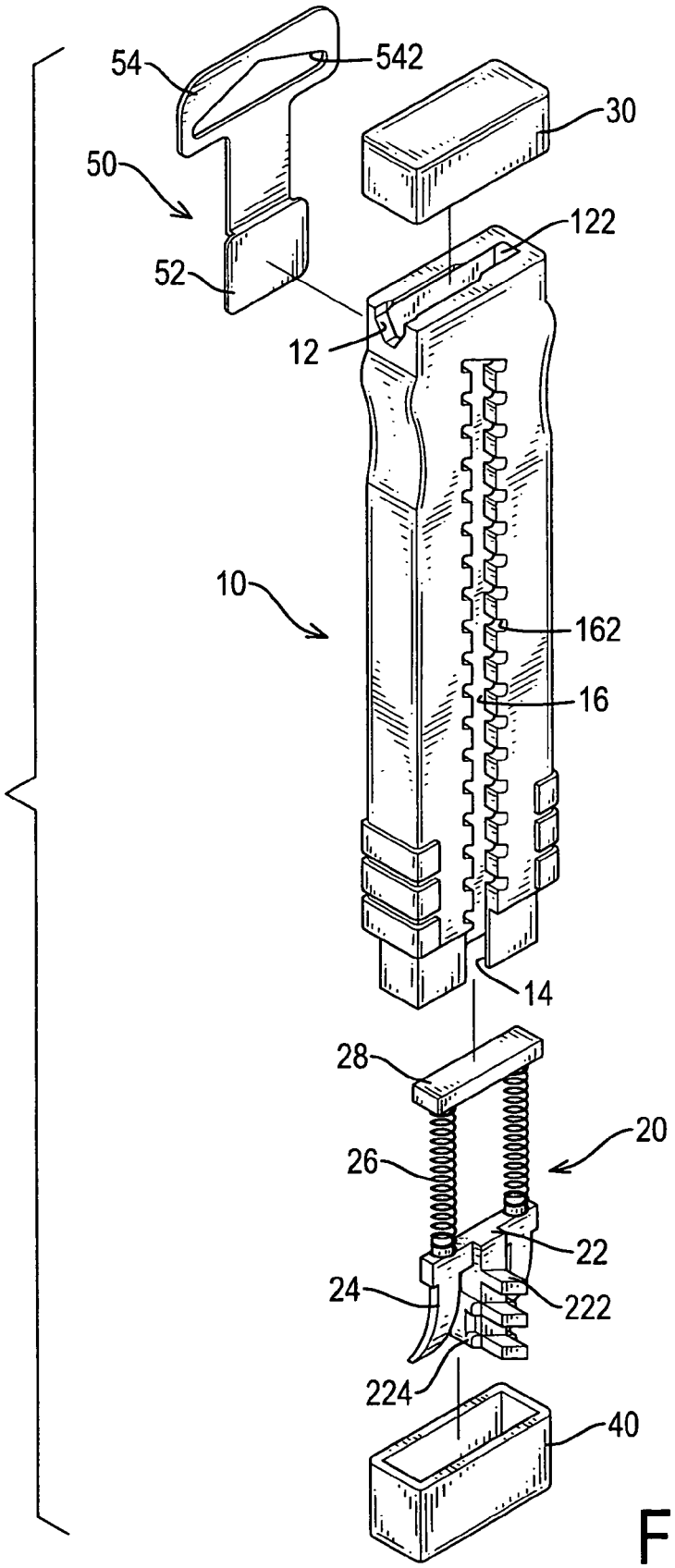
FIG. 1 is an exploded perspective view of a case for tool shafts in accordance with the present invention.
Figure 2:
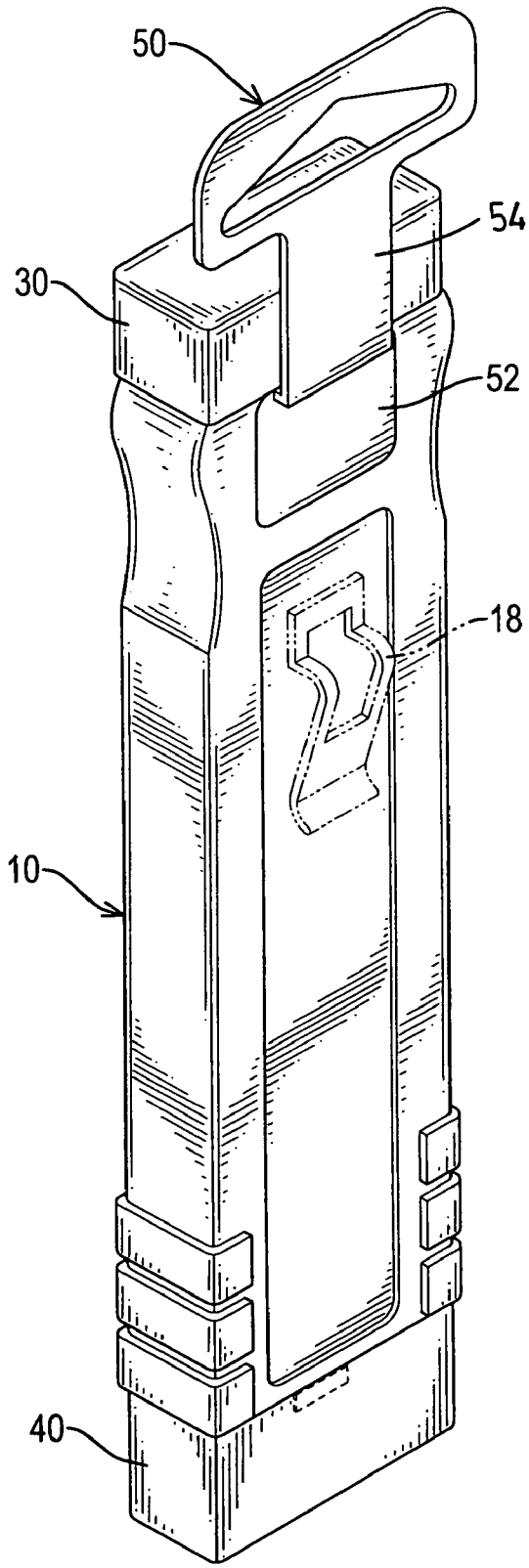
FIG. 2 is a rear perspective view of the case for tool shafts in FIG. 1.

With reference to FIGS. 1 and 2, a preferred embodiment of the case for tool shafts in accordance with the present invention comprises a rectangular housing (10), a sliding member (20), a top cap (30), a bottom cap (40), an optional suspension device (50) and an optional belt clip (18).

The rectangular housing (10) holds multiple tool shafts (not shown) transversally inside the housing (10) and has a top face (not numbered), a bottom (not numbered), a front face (not numbered), a rear face (not numbered), two side faces, an opening (12), an entrance (14) a guideway (16) and an optional slit (122). The opening (12) is defined in one of the side faces to allow the tool shafts to be inserted into or removed from the housing (10). The optional slit (122) is defined in the top face, communicates with the opening (12) and is shaped to correspond to but be slightly smaller than side edges of the multiple tool shafts to keep the tool shafts from passing through the slit (122). The slit (122) also provides a space for adjusting the tool shafts in parallel when the tool shafts have enlarged abutting ends and for pushing individual tool shafts out of the housing (10) by users so that a tool shaft at the opening (12) can be conveniently removed from the housing (10). The entrance (14) is defined in the bottom so the housing (10) can be refilled with multiple tool shafts. The guideway (16) is defined longitudinally in the front face, communicates with the entrance (14) at the bottom and has two longitudinal edges (162). The edges (162) respectively have multiple corresponding notches (not numbered) formed at an angle.

The sliding member (20) is mounted slidably inside the housing (10) and has a base (22), two resilient legs (24), multiple tabs (222), a push bar (28) and at least one biasing member (26). The base (22) has a front face (not numbered), a top face (not numbered) and two sides (not numbered). The two resilient legs (24) are attached respectively to and extending down from the two sides of the base (22), bending toward the rear face and abutting the inside of the housing (10) to press the front face of the base (22) against the inside of the front face of the housing (10). The tabs (222) are formed on and protrude from the front face of the base (22) parallel to each other and at an angle corresponding to the angle of the notches in the edges (162) of the guideway (16). Each tab (222) has a base joint (not numbered) and two opposite side edges (not numbered), and at least one tab (222) has two side extensions (224) protruding from the front face of the base (22) and respectively from the side edges of the at least one tab (222). The side extensions (224) selectively engage the notches on the edges (162) of the guideway (16) to hold the base (22) in position. The push bar (28) is mounted above the top face of the base (22). The at least one biasing member (26) is mounted between the top face of the base (22) and the push bar (28) to press the push bar (28) against the tool shafts mounted in the housing (10). The at least one biasing member is preferrably a spring clamped.

The top cap (30) detachably mounted on the top face of the housing (10) to close the opening (12), and the bottom cap (40) detachably mounted on the entrance (14).

The suspension device (50) is attached to the rear face of the housing (10) and has a lower attachment tab (52) attached to the rear face and an upper suspension portion (54) with a suspension hole (542) to hang the case on a protruding element (not shown) such as a hook or a peg. Additionally, the optional belt clip (18) is attached to the rear face of the housing (10) to attach the case conveniently to a belt (not shown) for trousers or a work belt (not shown).

Figure 3:
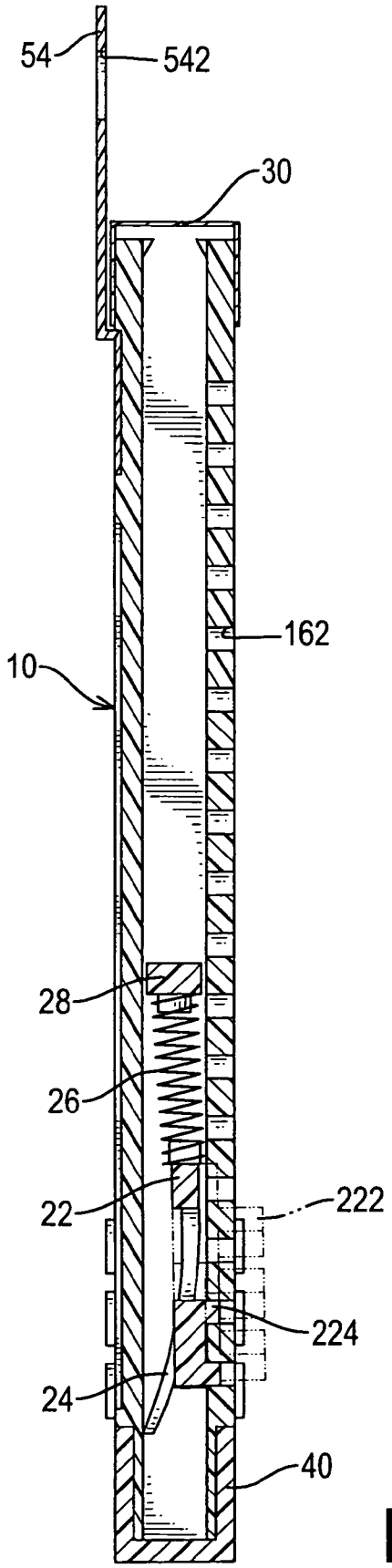
FIG. 3 is a cross-sectional side plan view of the case for tool shafts.
Figure 4:
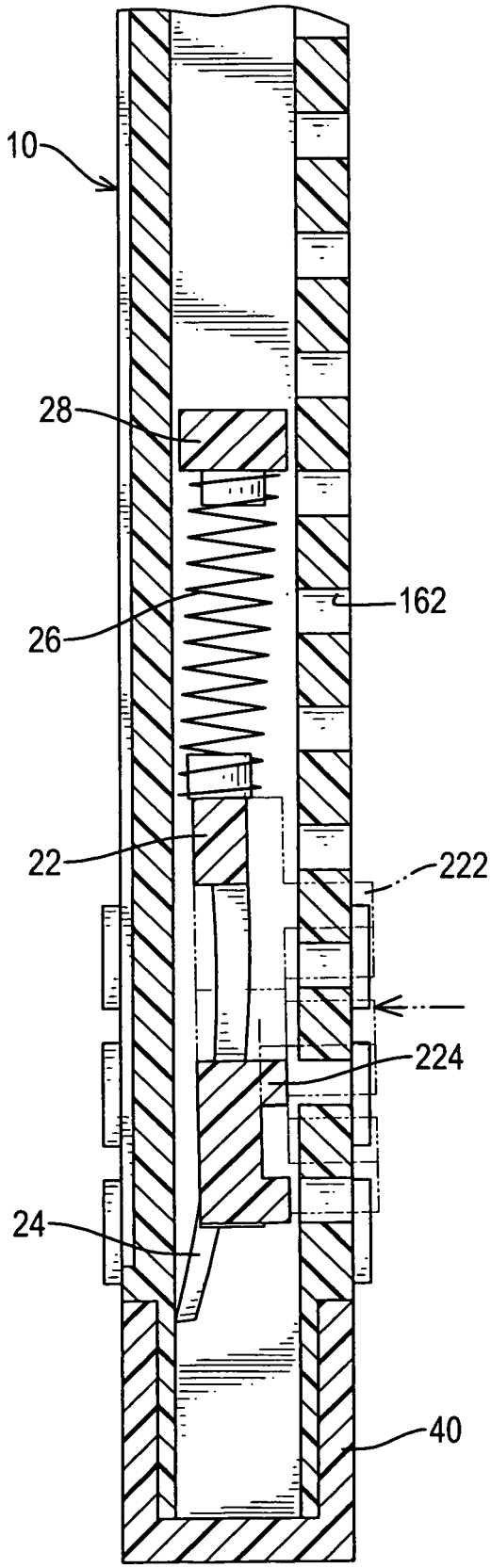
FIG. 4 is an enlarged operational cross-sectional side plan view of the case for tool shafts in FIG. 3.
Figure 5:
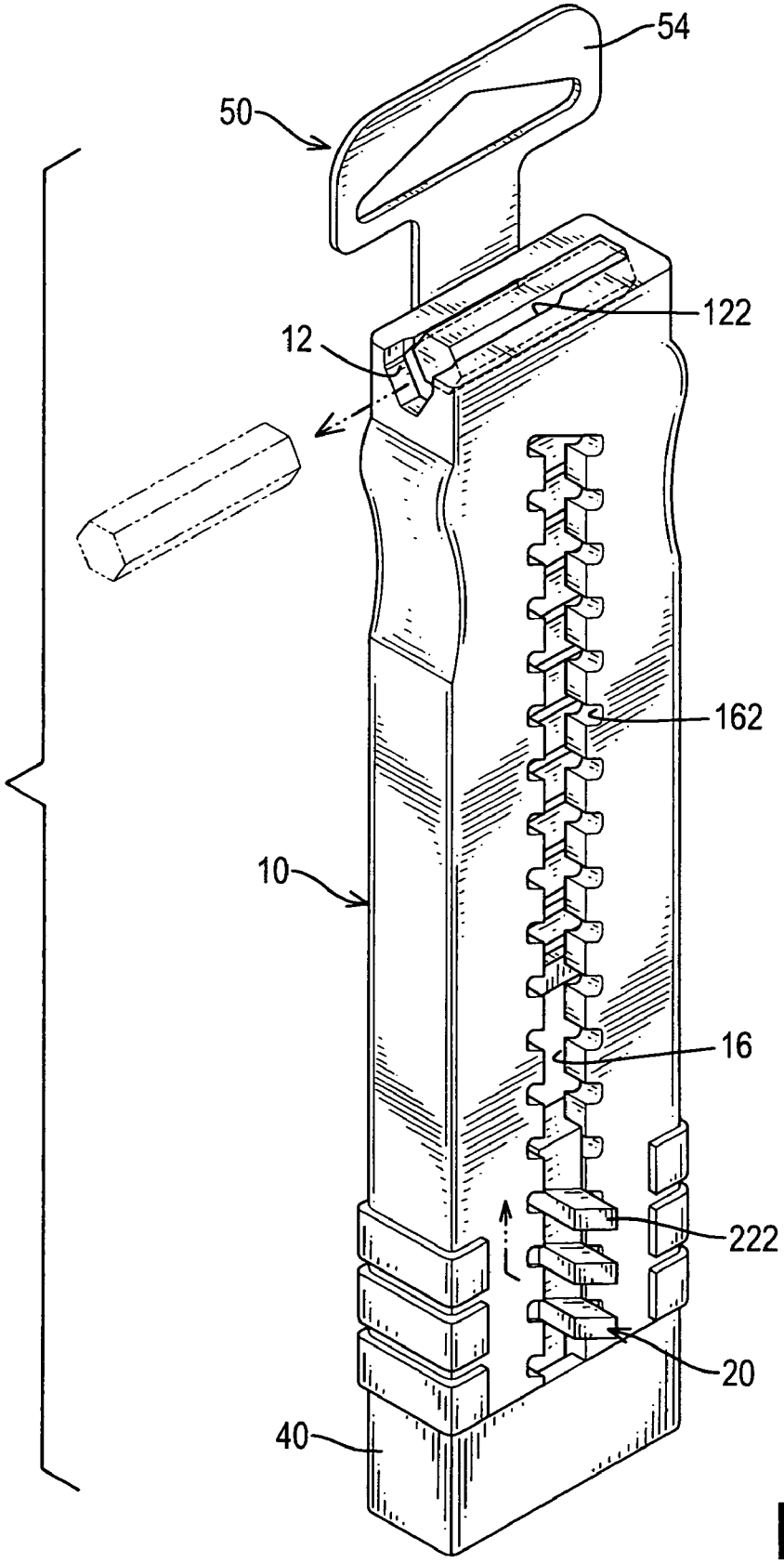
FIG. 5 is an operational perspective view of the case for tool shafts in FIG. 1 with a tool shaft removed from the case.
Figure 6:
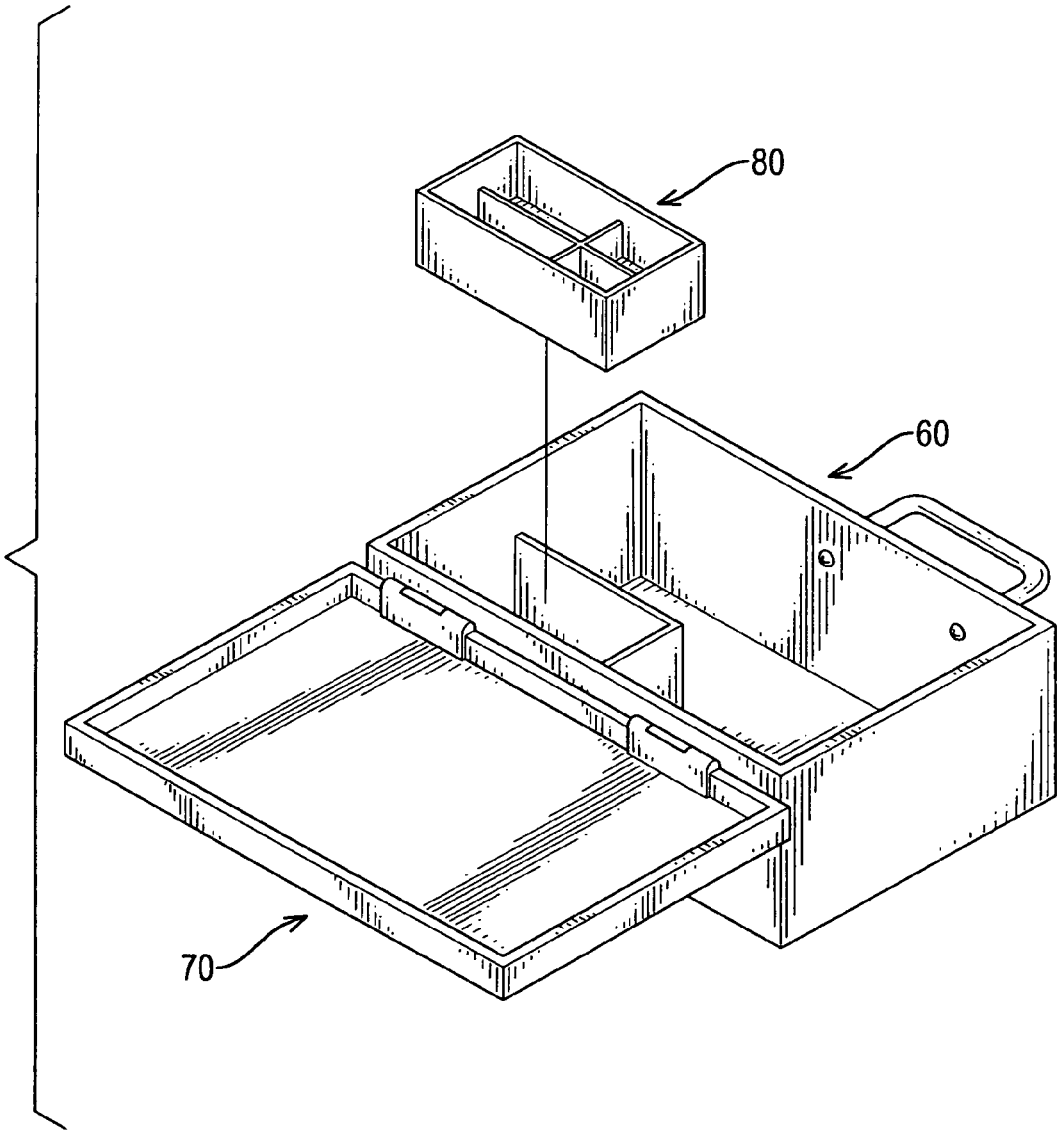
FIG.6 PRIOR ART
FIG. 6 is a perspective view of a conventional toolbox in accordance with the prior art.

With reference to FIGS. 3, 4 and 5, the top cap (30) has to be removed from the housing (10) to open the opening (12) so the tool shafts can be removed from the housing (10). Then, the tabs (222) are pressed to make the side extensions (224) disengage from the corresponding notches on the edges (162) of the guideway (16) so the sliding member (20) can be pushed upward until the topmost tool shafts is pushed into the slit (122) and aligns with the opening (12). The tool shaft in the slit (122) is pushed out of the case. Additionally, the tool shafts can be reloaded into the housing (10) after removing the bottom cap (40) and the sliding member (20) and are then inserted into the housing via the entrance (14) at the bottom of the housing (10).

The case for tool shafts as described has the following advantages:

1. Multiple tool shafts are gathered together in an orderly arrangement inside the case, which makes finding a particular tool shaft convenient.
2. The tool shafts are easily removed from the case by simply sequentially pushing the tool shafts to the opening by pressing and pushing the sliding member upward.

Although the invention has been explained in relation to its preferred embodiment, many other possible modifications and variations can be made without departing from the spirit and scope of the invention as hereinafter claimed.

What is claimed is:

1. A case for tool shafts comprising:

a housing (10) adapted to hold multiple tool shafts and having a top face;

a bottom;

a front face;

a rear face;

two side faces;

an opening (12) defined in one of the two side faces near the top face;

an entrance (14) defined in the bottom and adapted to allow the multiple tool shafts reloading through the entrance (14); and a guideway (16) defined longitudinally in the front face, communicating with the entrance (14) and having two longitudinally edges (162) with multiple notches;

a sliding member (20) slidably mounted inside the housing (10) and having a base (22) with a front face, a top face and two sides;

two resilient legs (24) attached respectively to and extending down from the sides of the base (22), bending toward the rear face of the housing (10) and abutting an inside bottom of the housing (10) to press the front face of the base (22) against an inside front of the front face of the housing (10);

multiple tabs (222) formed on and protruding from the front face of the base (22) parallel to each other and at an angle, extending out of the housing (10) through the guideway (16) and respectively having two opposite side edges; where at least one tab (222) has two side extensions (224) protruding from the front face of the base (22) and respectively from the side edges of the at least one tab (222) to selectively engage the notches in the edge (162) of the guideway (16);

a push bar (28) mounted in front of the base (22); and at least one biasing member (26) mounted between the top face of the base (22) and the push bar (28);

a top cap (30) detachably mounted on the top face of the housing (10) to close the opening (12); and a bottom cap (40) detachably mounted on the entrance (14).

2. The case for tool shafts as claimed in claim 1, wherein a suspension plate (50) is attached to the rear face of the housing (10).

3. The case for tool shafts as claimed in claim 2, wherein the suspension plate (50) has a lower attachment tab (52) attached to the rear face of the housing (10) and an upper suspension portion (54) with a suspension hole (542).

4. The case for tool shafts as claimed in claim 3, wherein a slit (122) is defined in the top face and communicates with the opening (12) to provide a space to keep the multiple tool shafts parallel at the opening (12).

5. The case for tool shafts as claimed in claim 4, wherein each one of the at least one biasing member is a spring.

6. The case for tool shafts as claimed in claim 1, wherein a belt clip (18) is attached on the rear face of the housing (10).

7. The case for tool shafts as claimed in claim 1, wherein a slit (122) is defined in the top face and communicates with the opening (12) to provide a space to keep the multiple tool shafts parallel at the opening (12).

* * * * *